US007568526B2

(12) United States Patent
de St. Remey et al.

(10) Patent No.: US 7,568,526 B2
(45) **Date of Patent: *Aug. 4, 2009**

(54) SUBTERRANEAN ELECTRO-THERMAL HEATING SYSTEM AND METHOD

(75) Inventors: Edward Everett de St. Remey, Anchorage, AK (US); David Parman, San Ramon, CA (US)

(73) Assignee: Tyco Thermal Controls LLC, Menlo Park, CA (US)

( * ) Notice: Subject to any disclaimer, the term of this patent is extended or adjusted under 35 U.S.C. 154(b) by 62 days.

This patent is subject to a terminal disclaimer.

(21) Appl. No.: 11/622,853

(22) Filed: Jan. 12, 2007

(65) Prior Publication Data

US 2007/0193747 A1 Aug. 23, 2007

Related U.S. Application Data

(63) Continuation-in-part of application No. 10/909,233, filed on Jul. 29, 2004, now Pat. No. 7,322,415.

(51) Int. Cl.
*E21B 36/02* (2006.01)

(52) U.S. Cl. ..... 166/302; 166/61; 166/901

(58) Field of Classification Search ..... 166/302, 166/57, 60, 61, 901
See application file for complete search history.

(56) References Cited

U.S. PATENT DOCUMENTS

| | | | | |
|---|---|---|---|---|
| 3,214,571 | A | 10/1965 | Indoe | |
| 3,861,029 | A | 1/1975 | Smith-Johannsen et al. | |
| 3,949,189 | A | 4/1976 | Bilbro et al. | |
| RE29,332 | E | 8/1977 | Bilbro et al. | |
| 4,068,966 | A | 1/1978 | Johnson et al. | |
| 4,123,837 | A | 11/1978 | Horner | |
| 4,152,577 | A | 5/1979 | Leavines | |
| 4,214,147 | A | 7/1980 | Kraver | |
| 4,284,841 | A | 8/1981 | Tijunelis et al. | |
| 4,303,826 | A | 12/1981 | Ando | |
| 4,490,577 | A | 12/1984 | Neuroth | |
| 4,538,682 | A | 9/1985 | McManus et al. | |
| 4,570,715 | A | 2/1986 | Van Meurs et al. | |
| 4,572,299 | A | 2/1986 | Vanegmond et al. | |
| 4,694,907 | A | 9/1987 | Stahl et al. | |
| 4,707,568 | A | 11/1987 | Hoffman et al. | |
| 5,070,533 | A | 12/1991 | Bridges et al. | |
| 5,086,836 | A | 2/1992 | Barth et al. | |
| 5,105,880 | A | 4/1992 | Shen | |
| 5,394,507 | A | 2/1995 | Okamoto | |
| 5,539,853 | A | 7/1996 | Jamaluddin et al. | |
| 5,714,106 | A | 2/1998 | Yoda et al. | |
| 5,782,301 | A | 7/1998 | Neuroth et al. | |
| 6,410,893 | B1 | 6/2002 | Yagnik et al. | |
| 7,322,415 | B2 * | 1/2008 | de St. Remey | 166/302 |
| 2006/0021752 | A1 | 2/2006 | De St. Remey | |

* cited by examiner

*Primary Examiner*—William P Neuder
(74) *Attorney, Agent, or Firm*—Wyatt Pratt, Esq.

(57) ABSTRACT

A subterranean electro-thermal heating system including one or more heater cable sections extending through one or more heat target regions of a subterranean environment and one or more cold lead sections coupled to the heater cable section(s) and extending through one or more non-target regions of the subterranean environment. A cold lead section delivers electrical power to a heater cable section but generates less heat than the heater cable section. The heater cable section(s) are arranged to deliver thermal input to one or more localized areas in the subterranean environment to vaporize a liquid, e.g. water.

20 Claims, 7 Drawing Sheets

SUBTERRANEAN ELECTRO-THERMAL HEATING SYSTEM AND METHOD

CROSS-REFERENCE TO RELATED APPLICATIONS

This application is a continuation-in-part of U.S. patent application Ser. No. 10/909,233, filed Jul. 29, 2004, the entire disclosure of which is incorporated herein by reference.

TECHNICAL FIELD

The present disclosure relates to subterranean heating and more particularly, to a subterranean electro-thermal heating system and method.

BACKGROUND

Heating systems may be used in subterranean environments for various purposes. In one application, a subterranean heating system may be used to facilitate oil production. Oil production rates have decreased in many of the world's oil reserves due to difficulties in extracting the heavy oil that remains in the formation. Various production-limiting issues may be confronted when oil is extracted from heavy oil field reservoirs. For example, the high viscosity of the oil may cause low-flow conditions. In oil containing high-paraffin, paraffin may precipitate out and form deposits on the production tube walls, thereby choking the flow as the oil is pumped. In high gas-cut oil wells, gas expansion may occur as the oil is brought to the surface, causing hydrate formation, which significantly lowers the oil temperature and thus the flow.

Heating the oil is one way to address these common production-limiting issues and to promote enhanced oil recovery (EOR). Both steam and electrical heaters have been used as a source of heat to promote EOR. One technique, referred to as heat tracing, includes the use of mechanical and/or electrical components placed on piping systems to maintain the system at a predetermined temperature. Steam may be circulated through tubes, or electrical components may be placed on the pipes to heat the oil.

These techniques have some drawbacks. Steam injection systems may be encumbered by inefficient energy use, maintenance problems, environmental constraints, and an inability to provide accurate and repeatable temperature control. Although electrical heating may be generally considered advantageous over steam injection heating, electrical heating systems may cause unnecessary heating in regions that do not require heating to facilitate oil flow. The unnecessary heating may be associated with inefficient power usage and may also cause environmental issues such as undesirable thawing of permafrost in arctic locations.

Accordingly, there is a need for a subterranean electro-thermal heating system that is capable of efficiently and reliably delivering thermal input to localized areas in a subterranean environment.

BRIEF DESCRIPTION OF THE DRAWINGS

Advantages of a system and method consistent with the present disclosure will be apparent from the following detailed description of exemplary embodiments thereof, which description should be considered in conjunction with the accompanying figures of the drawing, in which.

DETAILED DESCRIPTION

In general, a subterranean electro-thermal heating system consistent with the present invention may be used to deliver thermal input to one or more localized areas in a subterranean environment. Applications for a subterranean electro-thermal heating system consistent with the invention include, but are not limited to, oil reservoir thermal input for enhanced oil recovery (EOR), ground water or soil remediation processes, in situ steam generation for purposes of EOR or remediation, and in situ hydrocarbon cracking in localized areas to promote lowering of viscosity of oil or oil-laden deposits. Exemplary embodiments of a subterranean electro-thermal heating system are described in the context of oil production and EOR. It is to be understood, however, that the exemplary embodiments are described by way of explanation, and are not intended to be limiting.

Figure 1:
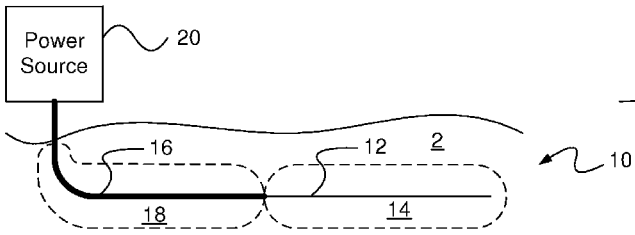
FIGS. 1-4 are schematic diagrams of different embodiments of a subterranean electro-thermal heating system consistent with the present disclosure including various arrangements of heater cable sections and cold lead sections.

FIG. 1 illustrates one exemplary embodiment 10 of a subterranean electro-thermal heating system. The illustrated exemplary system 10 includes a power source 20 electrically coupled to a heater cable section 12 through a cold lead cable section 16. The cold lead cable section 16 is disposed in a non-target region 18 of a subterranean environment 2, and the heater cable section 12 is disposed in a heat target region 14 of the subterranean environment 2. The heat target region 14 may be any region in the subterranean environment 2 where heat is desired, e.g. to facilitate oil flow. The non-target region 18 may be any region in the subterranean environment 2 where heat is not desired and thus is minimized, for example, to conserve power or to avoid application of significant heat to temperature sensitive areas such as permafrost in an arctic subterranean environment.

The length, configuration and number of the heater cable sections and the cold lead cable sections may vary depending on the application. In EOR applications, the exemplary cold lead section 16 may be at least about 700 meters in length and may extend up to about 1000 meters in length. Also, the heat generated in the cold lead section and heater cable sections may be directly related to the power consumption of these sections. In one embodiment, it is advantageous that the power consumed in the cold lead section(s) 16 be less than about 10% of the power consumed in the heater cable section (s) 12. In an EOR application, for example, power consumption in the heater cable section 12 may be about 100 watts/ft. and power consumption in the cold lead section 12 may be less than about 10 watts/ft. In another embodiment, the cold lead section(s) may be configured such that the voltage drop across the sections is less than or equal to 15% of the total voltage drop across all cold lead and heater cable sections in the system.

Those of ordinary skill in the art will recognize that power consumption and voltage drop in the cold lead sections may vary depending on the electrical characteristics of the particular system. Table 1 below illustrates the power consumption and line voltage drop for cold leads of various conductor sizes and lengths of 700, 800, 900, and 1000 meters in a system wherein the power source is a 480V single phase source and in a system wherein the power source is a 480V three phase source. Table 2 below illustrates the power consumption and line voltage drop for cold leads of various conductor sizes and lengths of 700, 800, 900, and 1000 meters in a system wherein the power source is a 600V single phase source and in a system wherein the power source is a 600V three phase source. For the exemplary configurations described in Tables 1 and 2, the cold lead conductor was sized to not exceed a 15% voltage drop or 10 watts/ft of well, and the conductor temperature was set at an average of 75° C.

TABLE 1

| | | 480 Volts 1 Phase | | | 480 Volts 3 Phase | | |
|---|---|---|---|---|---|---|---|
| | | 15 KW Current/Cond. | | | | | |
| | | | 31.3 Amps | | | 18.0 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 6 | 14 | 1.0 | 8 | 12 | 0.8 |
| 800 | 2625 | 4 | 11 | 0.6 | 8 | 14 | 0.8 |
| 900 | 2953 | 4 | 12 | 0.6 | 8 | 15 | 0.8 |
| 1000 | 3281 | 4 | 14 | 0.6 | 6 | 11 | 0.5 |
| | | 25 KW Current/Cond. | | | | | |
| | | | 52.1 Amps | | | 30.1 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 3 | 12 | 1.3 | 6 | 13 | 1.3 |
| 800 | 2625 | 3 | 14 | 1.3 | 6 | 14 | 1.3 |

TABLE 1-continued

| | | | | | | | |
|---|---|---|---|---|---|---|---|
| 900 | 2953 | 2 | 13 | 1.1 | 4 | 10 | 0.9 |
| 1000 | 3281 | 2 | 14 | 1.1 | 4 | 12 | 0.9 |
| | | 50 KW Current/Cond. | | | | | |
| | | | 104.2 Amps | | | 60.1 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 1/0 | 12 | 2.7 | 3 | 12 | 2.7 |
| 800 | 2625 | 1/0 | 14 | 2.7 | 3 | 14 | 2.7 |
| 900 | 2953 | 2/0 | 13 | 2.1 | 2 | 13 | 2.1 |
| 1000 | 3281 | 2/0 | 14 | 2.1 | 2 | 14 | 2.1 |

TABLE 2

| | | 600 Volts 1 Phase | | | 600 Volts 3 Phase | | |
|---|---|---|---|---|---|---|---|
| | | 15 KW Current/Cond. | | | | | |
| | | | 25.0 Amps | | | 14.4 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 8 | 15 | 1 | 10 | 12 | 0.8 |
| 800 | 2625 | 6 | 11 | 0.6 | 10 | 14 | 0.8 |
| 900 | 2953 | 6 | 12 | 0.6 | 8 | 10 | 0.5 |
| 1000 | 3281 | 6 | 14 | 0.6 | 8 | 11 | 0.5 |
| | | 25 KW Current/Cond. | | | | | |
| | | | 41.7 Amps | | | 24.1 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 4 | 10 | 1.1 | 8 | 13 | 1.4 |
| 800 | 2625 | 4 | 12 | 1.1 | 8 | 15 | 1.4 |
| 900 | 2953 | 4 | 13 | 1.1 | 6 | 10 | 0.9 |
| 1000 | 3281 | 4 | 15 | 1.1 | 6 | 11 | 0.9 |
| | | 50 KW Current/Cond. | | | | | |
| | | | 83.3 Amps | | | 48.1 Amps | |
| Lead Length | | Cond. | Volts Drop | W/Ft. of | Cond. | Volts Drop | W/Ft. of |
| Meters | Feet | Size | % | Well | Size | % | Well |
| 700 | 2297 | 2 | 13 | 2.7 | 4 | 10 | 2.2 |
| 800 | 2625 | 2 | 14 | 2.7 | 4 | 12 | 2.2 |
| 900 | 2953 | 1 | 13 | 2.2 | 4 | 13 | 2.2 |
| 1000 | 3281 | 1 | 14 | 2.2 | 4 | 15 | 2.2 |

Figure 2:
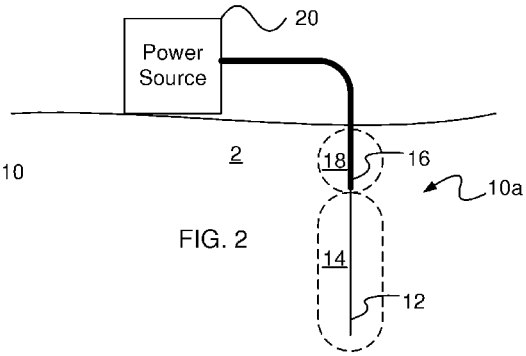

One or more cold lead and heater cable sections consistent with the present disclosure may be provided in a variety of configurations depending on system requirements. FIG. 2, for example, illustrates another exemplary embodiment 10*a* of a subterranean electro-thermal heating system consistent with the invention. In the illustrated embodiment, a heater cable section 12 and cold lead section 16 have a generally vertical orientation in the subterranean environment 2. The cold lead section 16 extends through a non-target region 18 of a subterranean environment 2 to electrically connect the heater cable section 12 in the heat target region 14 to the power source 20. Those of ordinary skill in the art will recognize that a system consistent with the invention is not limited to any particular orientation, but can be implemented in horizontal, vertical, or other orientations or combinations of orientations within the subterranean environment 12. The orientation for a given system may depend on the requirements of the system and/or the orientation of the regions to be heated.

Figure 3:
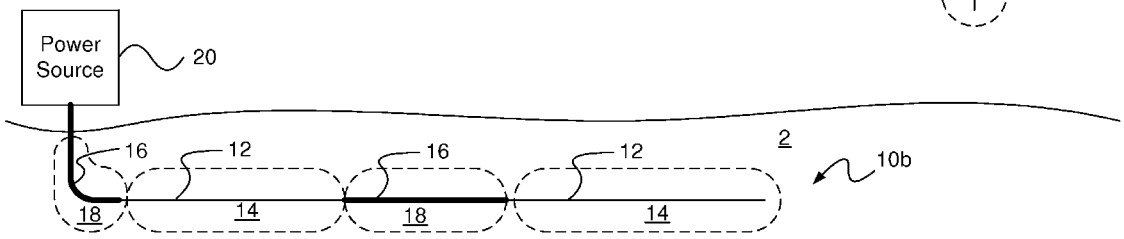
Figure 4:
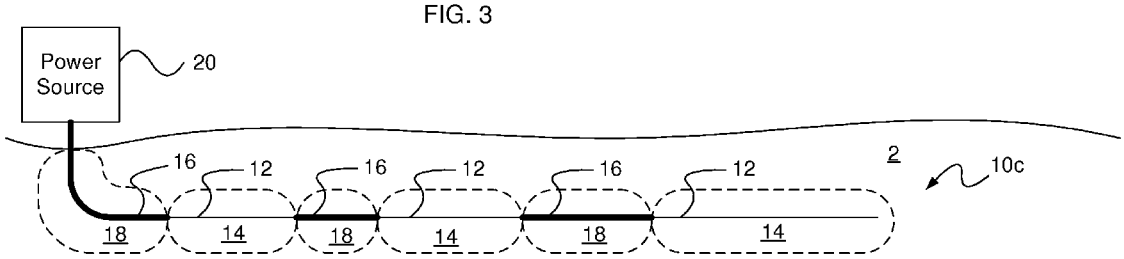

A system consistent with the invention may also be implemented in a segmented configuration, as shown, for example, in FIGS. 3 and 4. FIG. 3 illustrates a segmented subterranean electro-thermal heating system 10*b* including an arrangement of multiple heater cable sections 12 and cold lead sections 16. The heater cable sections 12 and the cold lead sections 16 are configured, interconnected and positioned based on a predefined pattern of heat target regions 14 and non-target regions 18 in the subterranean environment 2. Thus, the heater cable sections 12 and the cold lead sections 16 may be strategically located to focus the electro-thermal energy to multiple desired areas in the subterranean environment 2, while regulating the heat input and avoiding unnecessary heating. FIG. 4 shows another exemplary embodiment 10*c* of a system consistent with the invention wherein the heater cable sections 12 and cold lead sections 16 have various lengths depending upon the size of the corresponding heat target regions 14 and non-target regions 18. Although the exemplary embodiments show specific patterns, configurations, and orientations, the heater cable sections and cold lead sections can be arranged in other patterns, configurations and orientations.

The heater cable sections 12 may include any type of heater cable that converts electrical energy into heat. Such heater cables are generally known to those skilled in the art and can include, but are not limited to, standard three phase constant wattage cables, mineral insulated (MI) cables, and skin-effect tracing systems (STS).

One example of a MI cable includes three (3) equally spaced nichrome power conductors that are connected to a voltage source at a power end and electrically joined at a termination end, creating a constant current heating cable. The MI cable may also include an outer jacket made of a corrosion-resistant alloy such as the type available under the name Inconel.

In one example of a STS heating system, heat is generated on the inner surface of a ferromagnetic heat tube that is thermally coupled to a structure to be heated (e.g., to a pipe carrying oil). An electrically insulated, temperature-resistant conductor is installed inside the heat tube and connected to the tube at the far end. The tube and conductor are connected to an AC voltage source in a series connection. The return path of the circuit current is pulled to the inner surface of the heat tube by both the skin effect and the proximity effect between the heat tube and the conductor.

In one embodiment, the cold lead section 16 may be a cable configured to be electrically connected to the heater cable section 12 and to provide the electrical energy to the heater cable section 12 while generating less heat than the heater cable section 16. The design of the cold lead section 16 may depend upon the type of heater cable and the manner in which heat is generated using the heater cable. When the heater cable section 12 includes a conductor or bus wire and uses resistance to generate heat, for example, the cold lead section 16 may be configured with a conductor or bus wire with a lower the resistance (e.g., a larger cross-section). The lower resistance allows the cold lead section 16 to conduct electricity to the heater cable section 12 while minimizing or preventing generation of heat. When the heater cable section 12 is a STS heating system, the cold lead section 16 may be configured with a different material for the heat tube and with a different attachment between the tube and the conductor to minimize or prevent generation of heat.

In an EOR application, a subterranean electro-thermal heating system consistent with the present disclosure may be used to provide either downhole heating or bottom hole heating. The system may be secured to a structure containing oil, such as a production tube or an oil reservoir, to heat the oil in the structure. In these applications, at least one cold lead section 16 may be of appropriate length to pass through the soil to the location where the oil is to be heated, for example, to the desired location on the production tube or to the upper surface of the oil reservoir. A system consistent with the invention may also, or alternatively, be configured for indirectly heating oil within a structure. For example, the system may be configured for heating injected miscible gases or liquids which are then used to heat the oil to promote EOR.

Figure 5:
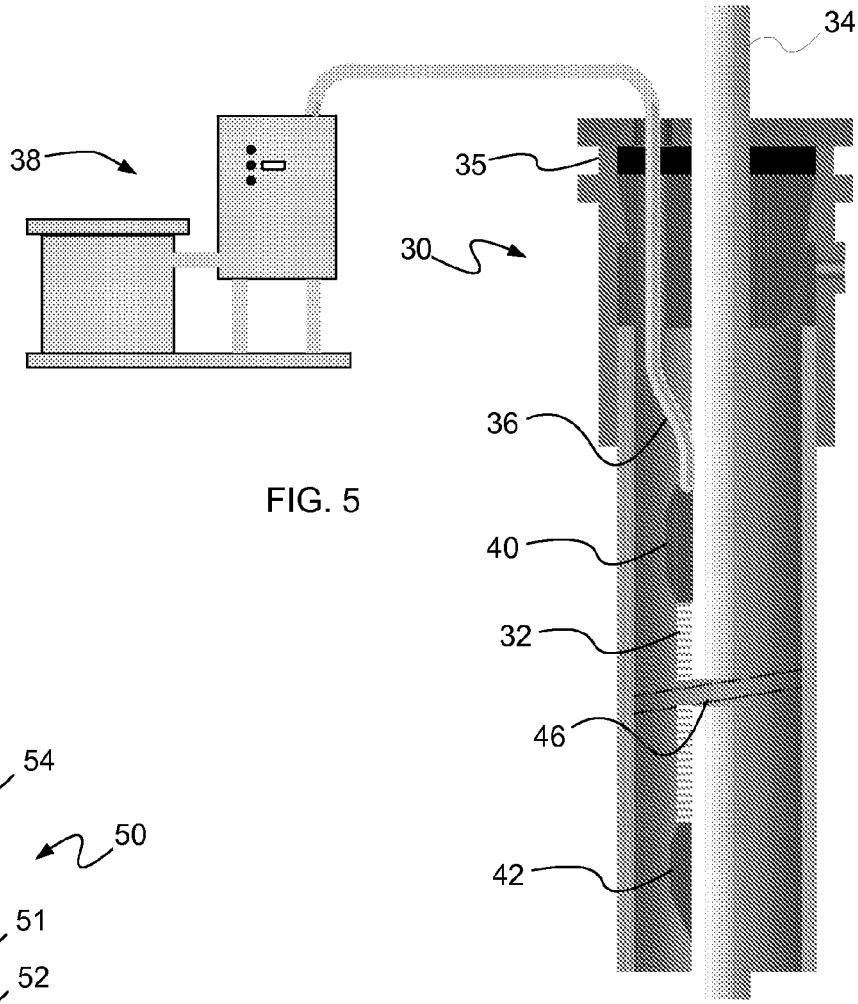
FIG. 5 is a schematic diagram of one embodiment of a subterranean electro-thermal heating system consistent with the present disclosure used for downhole heating.
Figure 7:
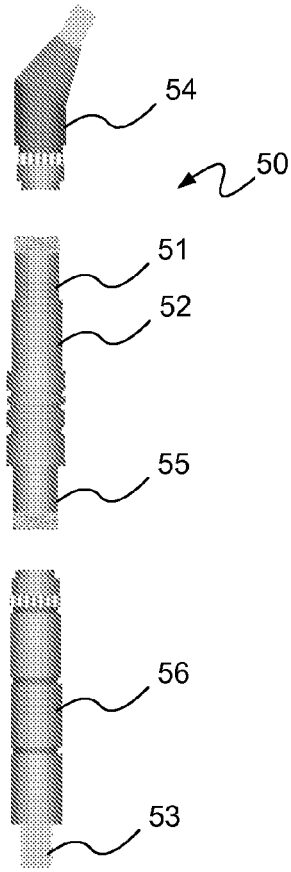
FIG. 7 is a schematic diagram of one embodiment of a pressurized-well feed-through assembly for connecting a cold lead to a heater cable in a downhole heating subterranean electro-thermal heating system used in a pressurized wellhead.
Figure 6:
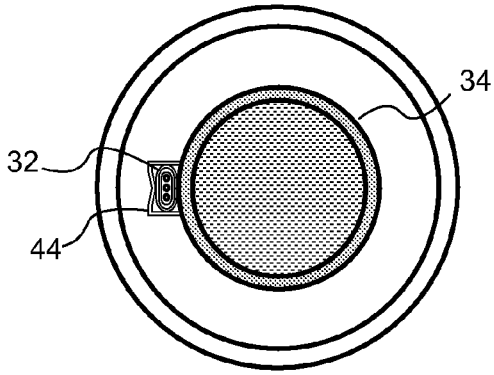
FIG. 6 is a schematic cross-sectional view of a heater cable secured to a production tube in the exemplary downhole heating subterranean electro-thermal heating system shown in FIG. 5.

One embodiment of a downhole subterranean electro-thermal heating system 30 consistent is shown in FIGS. 5-7. The exemplary downhole subterranean electro-thermal heating system 30 includes a heater cable section 32 secured to a production tube 34 and a cold lead section 36 connecting the heater cable section 32 to power source equipment 38, such as a power panel and transformer. A power connector 40 electrically connects the cold lead section 36 to the heater cable section 32 and an end termination 42 terminates the heater cable section 32.

The cold lead section 36 extends through a wellhead 35 and down a section of the production tube 34 to a location along the production tube 34 where heating is desired. The length of the cold lead section 36 extending down the production tube 34 can depend upon where the heating is desired along the production tube 34 to facilitate oil flow, and can be determined by one skilled in the art. The length of the cold lead section 36 extending down the production tube 34 can also depend upon the depth of any non-target region (e.g., a permafrost region) through which the cold lead section 36 extends. In one example, the cold lead section 36 extends about 700 meters and the heater cable section 32 extends down the oil well in a range from about 700 to 1500 meters. Although one heater cable section 32 and one cold lead section 36 are shown in this exemplary embodiment, other combinations of multiple heater cable sections 32 and cold lead sections 36 are contemplated, for example, to form a segmented configuration along the production tube 34.

One example of the heating cable section 32 is a fluoropolymer jacketed armored 3-phase constant wattage cable with three jacketed conductors, and one example of the cold lead section 36 is a 3-wire 10 sq. mm armored cable. The power connector 40 may include a milled steel housing with fluoropolymer insulators to provide mechanical protection as well as an electrical connection. The power connector 40 may also be mechanically and thermally protected by sealing it in a hollow cylindrical steel assembly using a series of grommets and potting with a silicone-based compound. The end termination 42 may include fused fluoropolymer insulators to provide mechanical protection as well as an electrical Y termination of the conductors in the heater cable section 32.

As shown in FIG. 6, the heater cable section 32 may be secured to the production tube 34 using a channel 44, such as a rigid steel channel, and fastening bands 46 spaced along the channel 44 (e.g., every four feet). The channel 44 protects the heater cable section 32 from abrasion and from being crushed and ensures consistent heat transfer from the heating cable section 32 to the fluid in the production tube 34. One example of the channel 44 is a 16 gauge steel channel and one example of the fastening bands 46 are 20 gauge ½ inch wide stainless steel.

In use, the heater cable section 32 may be unspooled and fastened onto the production tube 34 as the tube 34 is lowered into a well. Before lowering the last section of the production tube 34 into the well, the heater cable section 32 may be cut and spliced onto the cold lead section 36. The cold lead section 36 may be fed through the wellhead and connected to the power source equipment 38. For non-pressurized wellheads, the cold lead section 36 may be spliced directly to the heater cable section 32 using the power connector 40.

For pressurized wellheads, a power feed-through mandrel assembly 50, shown for example in FIG. 7, may be used to penetrate the wellhead. The illustrated exemplary power feed-through mandrel assembly 50 includes a mandrel 52 that passes through the pressurized wellhead. A surface plug connector 54 is electrically coupled to the power source and connects to an upper connector 51 of the mandrel 52. A lower plug connector 56 is coupled to one of the system cables 53 (i.e. either a heater cable section or a cold lead section) and connects to a lower connector 55 of the mandrel 52.

Figure 8:
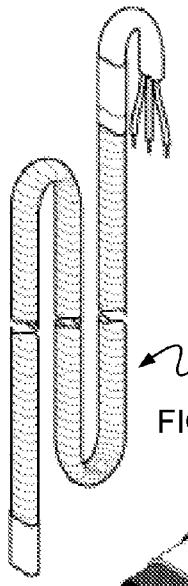
FIG. 8 is a schematic perspective view of one embodiment of an externally installed downhole heater cable consistent with the present disclosure.
Figure 9:
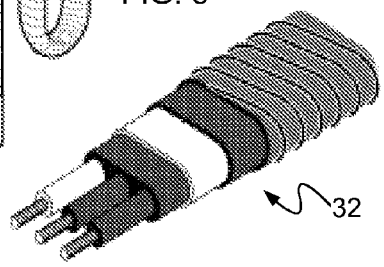
FIG. 9 is a schematic cross-sectional view of the heater cable shown in FIG. 8.

Again, those of ordinary skill in the art will recognize a variety of cable constructions that may be used as a heater cable in a system consistent with the present disclosure. One exemplary embodiment of an externally installed downhole heater cable section 32 for use in non-pressurized wells is shown in FIGS. 8-9. This exemplary heater cable section 32 provides three-phase power producing 11 to 14 watts/ft. and may be installed on the exterior of the production tube within a channel, as described above.

Figure 10:
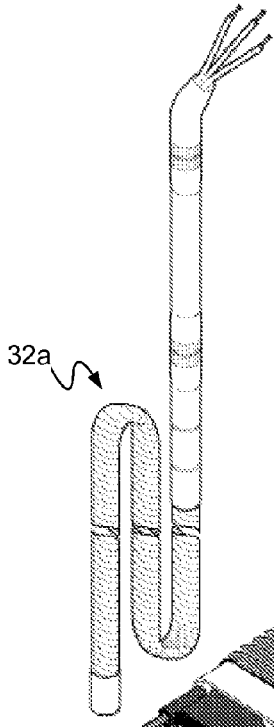
FIG. 10 is a schematic perspective view of another embodiment of an externally installed downhole heater cable consistent with the present disclosure.
Figure 11:
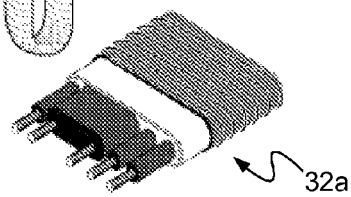
FIG. 11 is a schematic cross-sectional view of the heater cable shown in FIG. 10.

FIGS. 10-11 illustrate another embodiment 32*a* of an externally installed downhole heater cable section for use in pressurized wells. The exemplary cable section 32*a* provides three-phase power producing 14 to 18 watts/ft. and may be installed on the exterior of the production tube within a channel and using the feed-through mandrel, as described above.

Figure 12:
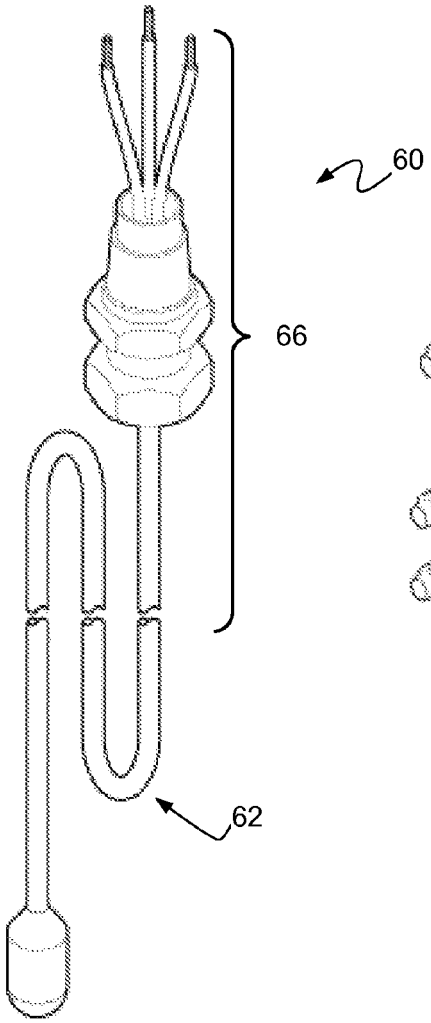
FIG. 12 is a schematic perspective view of one embodiment of an internally installed downhole heater cable consistent with the present disclosure.
Figure 13:
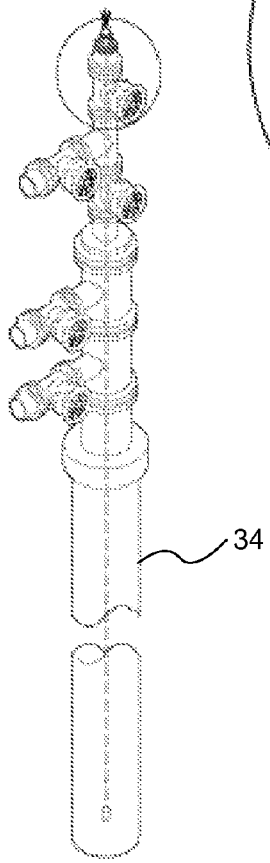
FIGS. 13-14 are schematic perspective views of the internally installed downhole heater cable shown in FIG. 12 installed in a production tube.
Figure 14:
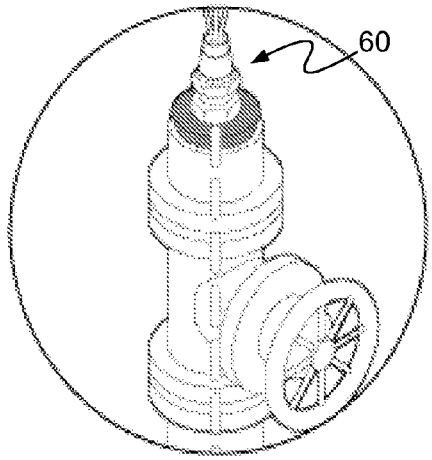

Another embodiment of a downhole subterranean electro-thermal heating system 60 includes an internally installed downhole heater cable section 62 and cold lead section 66 for use in pressurized or non-pressurized wells, as shown in FIGS. 12-14. The exemplary internally installed heater cable section 62 provides three phase power and produces 8 to 10 watts/ft. The internally installed heater cable section 62 may have a small diameter (e.g., of about ¼ in.) and may be provided as a continuous cable without a splice in a length of about 700 meters. The internally installed heater cable section 62 may also have a corrosion resistant sheath constructed, for example, of Incoloy 825. The internally installed heater cable section 62 can be relatively easily installed without pulling the production tubing.

Figure 15:
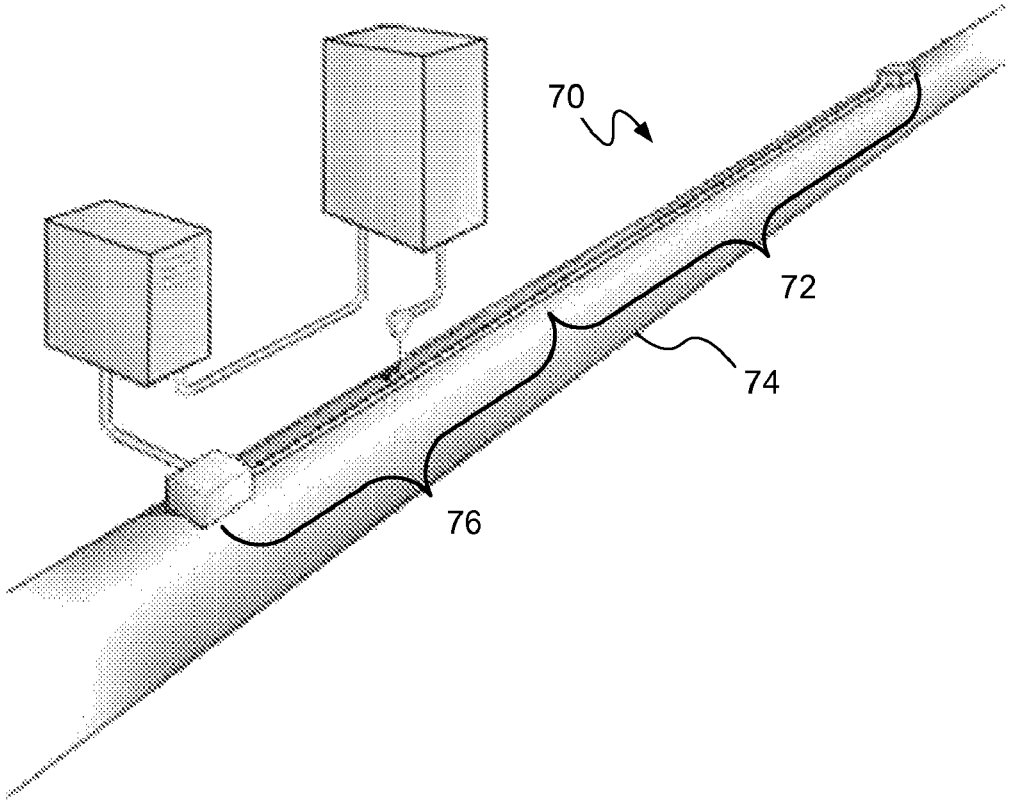
FIG. 15 is a schematic diagram of another embodiment of a subterranean electro-thermal heating system consistent with the present disclosure.

Another embodiment of a subterranean electro-thermal heating system 70 is shown in FIG. 15. In this embodiment, a STS heater cable section 72 having a cold lead section 76 coupled thereto is secured to a reservoir or pipe 74 running generally horizontally in the subterranean environment. Although one STS heater cable section 72 and one cold lead section 76 are shown, other combinations of multiple STS heater cable sections 72 and cold lead sections 76 are contemplated, for example, to form a segmented configuration along the reservoir or pipe 74.

Figure 16:
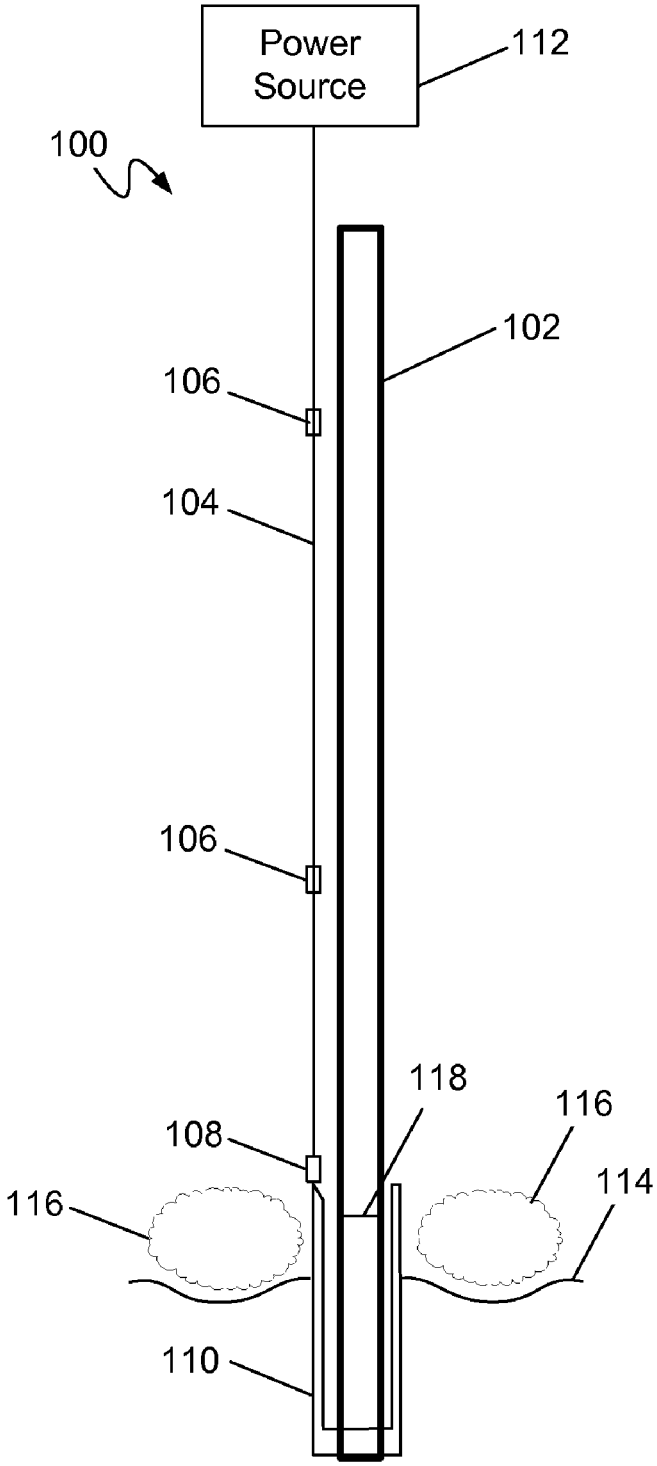
FIG. 16 is a schematic diagram of an embodiment of a subterranean electro-thermal heating system configured for in situ steam generation consistent with the present disclosure.

As noted above, the subterranean electro-thermal heating systems described herein may be employed for in situ steam generation, e.g., to promote EOR. Another embodiment of a subterranean electro-thermal heating system 100 that may be employed for in situ steam generation is generally depicted in FIG. 16. The system 100 may generally include a power source 112 coupled, i.e., electrically and/or mechanically coupled, to a cold lead cable section 104. The cold lead cable section 104 may include one or more cable segments coupled to one another via one or more cold/cold cable splices 106. The cold lead cable section 104 may be coupled to a heater cable section 110, e.g., via one or more hot/cold cable splices 108. The heater cable section 110 may generate a thermal output which is greater than a thermal output of the cold lead cable section.

As shown, in one embodiment, the heater cable section 110 may be disposed on or adjacent the exterior surface of an oil production tube 102. In the illustrated exemplary embodiment, the heater cable section 110 extends generally along a first side of the production tube and then across the production tube and along a second side of the tube. It is to be understood, however, that the heater cable section may be positioned in any configuration relative to the production tube. For example, the heater cable section may extend along only a first side of the tube, may wrap around the tube, may extend on one or more sides of the tube at an angle thereto, etc. Also, any number of cold lead cable sections and heater cable sections may be provided in a system consistent with the present disclosure.

At least a portion of the heater cable section 110 may be thermally coupled to a fluid 114 in the near-well bore area, i.e., in the area surrounding and/or adjacent to the well bore and/or the production tube 102. For example, the heater cable section 110 may be at least partially disposed in, or adjacent to, the fluid 114 to impart the heater cable thermal output to the fluid 114. As shown, at least a portion of the heater cable section 110 may be immersed in the fluid 114.

The fluid 114 in the near-well bore area may be heated by the heater cable section 110, e.g., by the heater cable thermal output, to provide in situ steam generation. In one embodiment, the fluid 114 may include water, either alone or in combination with other fluids, liquids and/or solids. The heater cable section 110 may heat the water to vaporize the water and produce steam 116 in the near-well bore area. In related embodiments, the fluid may include a gaseous fluid, or a liquid other than water. The fluid 114 may be in thermal contact with water, such that when the fluid is heated by the heater cable section 110, the fluid 114 may heat the water to provide in situ steam generation.

In one exemplary embodiment, the fluid 114 may generally be heated by the heater cable thermal output to attain temperatures in the range of between about 200° F. to about 250° F. or higher. Temperatures in the foregoing range may generally be sufficient to convert water in the vicinity of the near-well bore into a gas, i.e., into steam. The fluid temperature required to convert the water into steam may vary depending upon the constituents of the fluid, the depth, and thereby the ambient pressure of the fluid, the degree of thermal contact between the fluid and water, etc. Accordingly, it will be appreciated that temperatures above and/or below the foregoing temperature range may suitably be employed.

According to one aspect, steam in the near-well bore area may accelerate oil mobility, and hence oil flow into and through the production tube. Steam in the near-well bore area may heat oil 118 near the bottom of the production tube, or in the near-well bore area, to temperatures greater than or equal to 200° F. In one embodiment, steam may heat oil near in the production tube, e.g. at the production tube intake, to temperatures greater than or equal to 215° F. Heating the oil reduces oil viscosity allowing more oil from the subterranean environment, oil reservoir, etc., to flow into and through the production tube 102.

In addition to increasing the mobility of oil in the near-well bore area and/or of oil 118 near the bottom of the well or production tube, and thereby increasing production, a subterranean electro-thermal heating system consistent with the present disclosure may also provide a reduction, or elimination, of water and gas from the produced oil through the release of water, and/or gas, via the in situ steam generation. The water which is turned into steam may be released from the oil, and may not be extracted via the production tube 102. By recovering only oil, or at least a higher content of oil, the oil production rates may be increased, e.g., as a result of the viscosity reduction and elimination or reduction of produced water.

In addition to the in situ generation of steam, i.e., heated water vapor, various other fluids present in the near-well bore area may be vaporized by the heater cable section 110 to provide a heated gas in the near-well bore area. The heated gasses may increase mobility of oil in the near-well bore area and may also decrease the viscosity of oil within the well. In part, the decreased viscosity of the oil may increase oil mobility, and therefore inflow, of oil in the near-well bore area. Additionally, the decreased oil viscosity may increase extraction of oil from the well via the production tube. Furthermore, any liquids heated and converted to a gas may be released from the oil. Oil extracted from the well may, therefore, exhibit a reduced amount of contaminants and intermixed materials, thereby increasing the oil production rate from the well.

Figure 17:
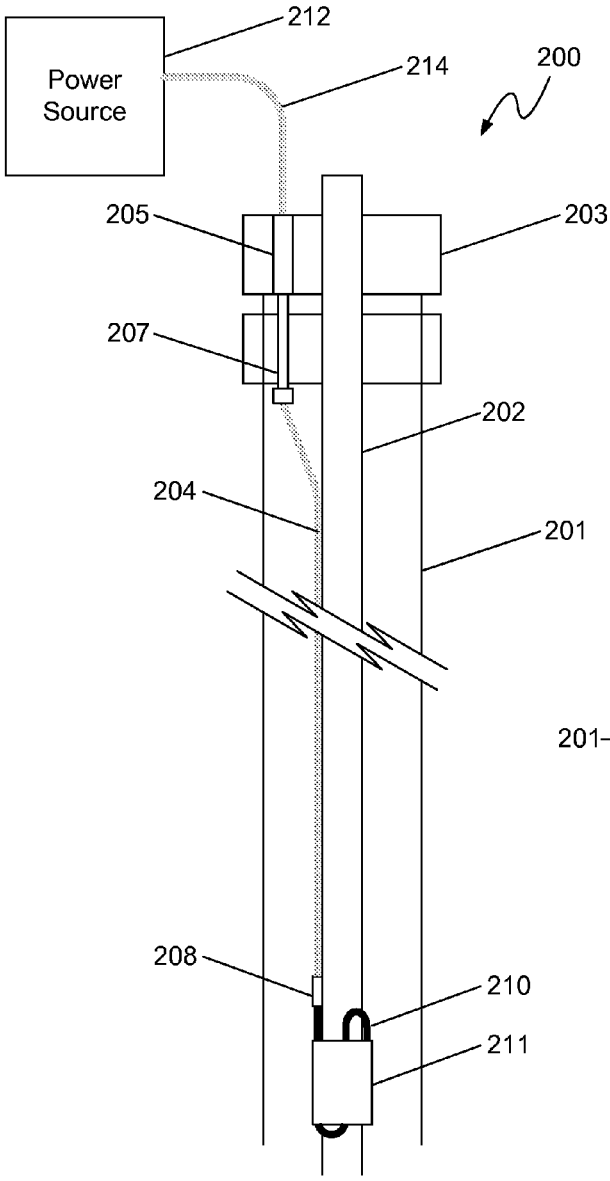
FIG. 17 is a schematic view of another embodiment of a subterranean electro-thermal heating system configured for in situ steam generation consistent with the present disclosure.
Figure 18:
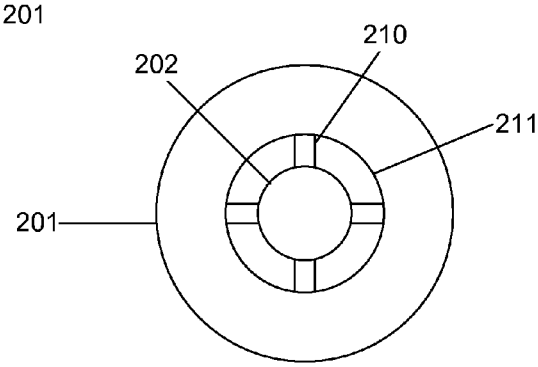
FIG. 18 is a detailed cross-sectional view of a portion of the system of FIG. 17 including the heating cable.

Referring to FIGS. 17 and 18, another embodiment of a subterranean electro-thermal heating system 200 is shown. Similar to the preceding embodiment, the system 200 may generally include a power source 212 coupled, i.e., electrically and/or mechanically coupled, to a cold lead cable section 204, which may in turn be coupled to a heater cable section 210. In the illustrated embodiment, the production tube 202, the cold lead cable section 204 and the heater cable section 210 may be disposed within the well casing 201, with the cold lead cable section 204 and the heater cable section 210 disposed exterior to the production tube 202. A power cable 214 may couple the power source 212 to an upper electrical connector 205 extending through the well head 203. An electrical penetrator 207 may extend from the upper electrical connector 205 and may be coupled the cold lead cable section 204. Consistent with the foregoing description, the electrical penetrator 207 and upper electrical connector 205 may provide external attachment of the cold lead cable section 204 to the power source 212.

With additional reference to FIG. 18, at least a portion of the heater cable section 210 may be secured to the production tube 202 using a channel 211. In the illustrated embodiment, the channel 211 may be a generally cylindrical sleeve disposed around at least a portion of the production tube 202 and the heater cable section 210, which may be on the exterior of the production tube 202. The channel 211 may protect the heater cable section 210 from abrasion and from being crushed. The channel 211 may be any suitable, abrasion and/or crush resistant structure, such as a sheet steel cylinder. The heater cable section 210 may be disposed around the perimeter of the production tube 202 between the channel 211 and the production tube 202, e.g. by looping through the channel 211 as shown.

According to one aspect of the disclosure, therefore, there is provided a subterranean electro-thermal heating system including: at least one heater cable section disposed adjacent and outside of an oil production tube in a subterranean environment, the heater cable section being configured to provide a heater cable thermal output to vaporize a fluid adjacent the oil production tube, and at least one cold lead section electrically coupled to the heater cable section and extending through at least one non-target region of the subterranean environment for delivering electrical energy to the heater cable section, the cold lead section being configured to generate a cold lead thermal output less the heater cable thermal output.

According to another aspect of the disclosure, there is provided a subterranean electro-thermal heating system including: at least one heater cable section disposed adjacent and outside of a fluid-containing structure in a subterranean environment, the heater cable section being configured to provide a heater cable thermal output to heat a fluid within the fluid-containing structure to a temperature greater than or equal to 215° F.; and at least one cold lead section electrically coupled to the heater cable section and extending through at least one non-target region of the subterranean environment for delivering electrical energy to the heater cable section, the cold lead section being configured to generate a cold lead thermal output less the heater cable thermal output.

According to yet another aspect of the disclosure, there is provided a method of increasing oil production from an oil production tube, the method comprising: electrically coupling at least one cold lead cable section with at least one heater cable section, the cold lead section being configured to generate a cold lead thermal output less than the heater cable thermal output; positioning the cold lead cable section and the heater cable section outside of the oil production tube; and delivering electrical energy to the heater cable section through the cold lead cable section to vaporize a fluid adjacent the oil production tube and thereby heat the oil in the oil production tube.

While the principles of the invention have been described herein, it is to be understood that this description is made only by way of example and not as a limitation as to the scope of the invention. Other embodiments are contemplated within the scope of the present disclosure in addition to the exemplary embodiments shown and described herein. Also, the features and aspects of any embodiment described herein may be combined with features and aspects of any other embodiment described herein. Modifications and substitutions by one of ordinary skill in the art are considered to be within the scope of the present disclosure, which is not to be limited except by the following claims.

What is claimed is:

1. A subterranean electro-thermal heating system comprising:

at least one heater cable section disposed outside of an oil production tube in a subterranean environment, said heater cable section being configured to provide a heater cable thermal output to vaporize a fluid adjacent said oil production tube; and at least one cold lead section electrically coupled to said heater cable section and extending through at least one non-target region of said subterranean environment for delivering electrical energy to said heater cable section, said cold lead section being configured to generate a cold lead thermal output less said heater cable thermal output.

2. The system of claim 1 wherein said heater cable section is positioned to impart said heater cable thermal output to vaporize said fluid and thereby heat oil within said oil production tube to a temperature greater than or equal to 200° F.

3. The system of claim 1 wherein said fluid comprises water and wherein said heater cable section is positioned to impart said heater cable thermal output to vaporize said water and thereby heat oil within said oil production tube.

4. The system of claim 1 wherein said heater cable section is at least partially disposed in said fluid.

5. The system of claim 1 wherein said heater cable section is coupled to said oil production tube by a generally cylindrical sleeve disposed around at least a portion of said oil production tube.

6. The system of claim 1 wherein said at least one said cold lead section has a length greater than or equal to 700 meters.

7. The system of claim 1 wherein said at least one cold lead section is configured to consume less than or equal to 10% of the power consumed by said at least one heater cable section.

8. The system of claim 1 wherein said at least one cold lead section is configured such that a voltage drop across said cold lead section is less than or equal to 15% of a total voltage drop across said at least one cold lead section and said at least one heater cable section.

9. A subterranean electro-thermal heating system comprising:

at least one heater cable section disposed outside of a fluid-containing structure comprising an oil production tube in a subterranean environment, said heater cable section being configured to provide a heater cable thermal output to heat a fluid within said fluid-containing structure to a temperature greater than or equal to 215° F.; and at least one cold lead section electrically coupled to said heater cable section and extending through at least one non-target region of said subterranean environment for delivering electrical energy to said heater cable section, said cold lead section being configured to generate a cold lead thermal output less said heater cable thermal output.

10. The system of claim 9 wherein said fluid within said fluid-containing structure comprises oil.

11. The system of claim 10 wherein said heater cable section is positioned to impart said heater cable thermal output to vaporize a second fluid adjacent said fluid containing structure.

12. The system of claim 11 wherein said heater cable section is at least partially disposed in said second fluid.

13. The system of claim 9 wherein said heater cable section is coupled to said oil production tube by a generally cylindrical sleeve disposed around at least a portion of said oil production tube.

14. The system of claim 9 wherein said at least one said cold lead section has a length greater than or equal to 700 meters.

15. The system of claim 9 wherein said at least one cold lead section is configured to consume less than or equal to 10% of the power consumed by said at least one heater cable section.

16. The system of claim 9 wherein said at least one cold lead section is configured such that a voltage drop across said cold lead section is less than or equal to 15% of a total voltage drop across said at least one cold lead section and said at least one heater cable section.

17. A method of increasing oil production from an oil production tube, said method comprising:

electrically coupling at least one cold lead cable section with at least one heater cable section, said cold lead section being configured to generate a cold lead thermal output less than said heater cable thermal output;

positioning said cold lead cable section and said heater cable section outside of the oil production tube; and delivering electrical energy to said heater cable section through said cold lead cable section to vaporize a fluid adjacent the oil production tube and thereby heat the oil in the oil production tube.

18. The method of claim 17 wherein said delivering-electrical energy comprises delivering electrical energy to said heater cable section through said cold lead cable section to vaporize said fluid adjacent the oil production tube and thereby heat the oil in the oil production tube to a temperature greater than or equal to 200° F.

19. The method of claim 17 wherein said at least one cold lead section is configured to consume Less than or equal to 10% of the power consumed by said at least one heater cable section.

20. The method of claim 17 wherein said at least one cold lead section is configured such that a voltage drop across said cold lead section is less than or equal to 15% of a total voltage drop across said at least one cold lead section and said at least one heater cable section.

* * * * *